US006558204B1

(12) United States Patent
Weatherley

(10) Patent No.: US 6,558,204 B1
(45) Date of Patent: May 6, 2003

(54) PLUG ASSEMBLY FOR DATA TRANSMISSION AND METHOD OF WIRING SAME

(76) Inventor: Richard Weatherley, 43-45 Salthouse Road, Cornwell Business Park, Brackmills, Northampton NN4 7EX (GB)

( * ) Notice: Subject to any disclaimer, the term of this patent is extended or adjusted under 35 U.S.C. 154(b) by 0 days.

(21) Appl. No.: 09/913,650

(22) PCT Filed: Feb. 18, 2000

(86) PCT No.: PCT/GB00/00584

§ 371 (c)(1),
(2), (4) Date: Nov. 9, 2001

(87) PCT Pub. No.: WO00/49683

PCT Pub. Date: Aug. 24, 2000

(30) Foreign Application Priority Data

Feb. 19, 1999 (GB) ..... 9903911
Mar. 31, 1999 (GB) ..... 9907480

(51) Int. Cl.[7] ..... H01R 24/00
(52) U.S. Cl. ..... 439/676; 439/344
(58) Field of Search ..... 439/692, 344, 439/404, 676, 941, 942, 418

(56) References Cited

U.S. PATENT DOCUMENTS 5,571,035 A 11/1996 Ferrill ..... 439/894
5,628,647 A 5/1997 Rohrbaugh et al. ..... 439/404
6,080,007 A * 6/2000 Dupuis et al. ..... 439/418
6,099,345 A * 8/2000 Milner et al. ..... 439/460
6,280,232 B1 * 8/2001 Beecher et al. ..... 439/418

FOREIGN PATENT DOCUMENTS

| | | |
|---|---|---|
| DE | 19649668 | 5/1998 |
| EP | 0793305 | 9/1997 |
| GB | 2286297 | 9/1995 |
| GB | 2344706 | 6/2000 |
| WO | 9917406 | 4/1999 |

* cited by examiner

*Primary Examiner*—P. Austin Bradley
*Assistant Examiner*—Ross Gushi
(74) *Attorney, Agent, or Firm*—Dykema Gossett PLLC

(57) ABSTRACT

A plug assembly for data transmission includes a wiring manifold (36) which controls the position of the conductors between the point where the cable connected to the plug enters the plug and the contacts of the plug. The cable consists of four twisted pairs of conductors AB, CD, EF and GH and the conductors are presented to the plug contacts in the sequence ABCFEDGH. The wiring manifold (36) constrains the conductors to run with the C conductor adjacent the E conductor. Preferably, the D conductor is constrained to run adjacent the F conductor. The arrangement reduces cross-talk induced between the connectors within the plug and leads to a consistent and predictable level of cross-talk which can be reduced or cancelled using suitable components associated with a jack into which the plug is, in use, inserted.

10 Claims, 8 Drawing Sheets

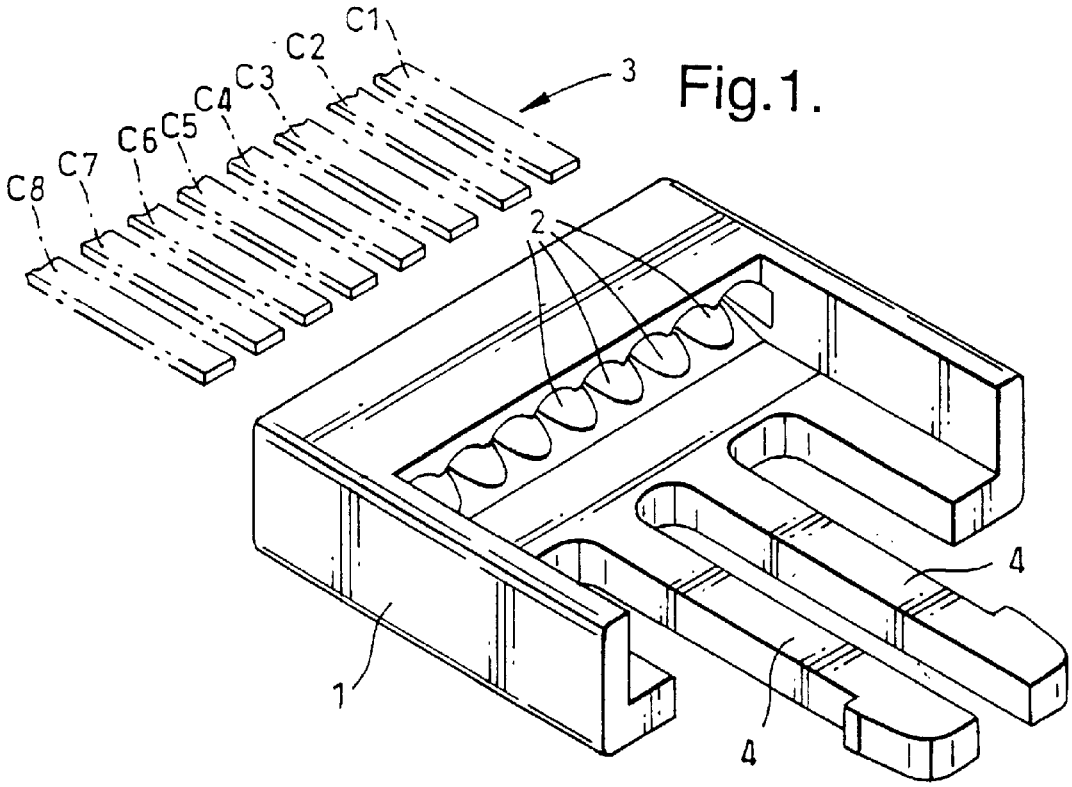
Fig.1.
Fig.2.
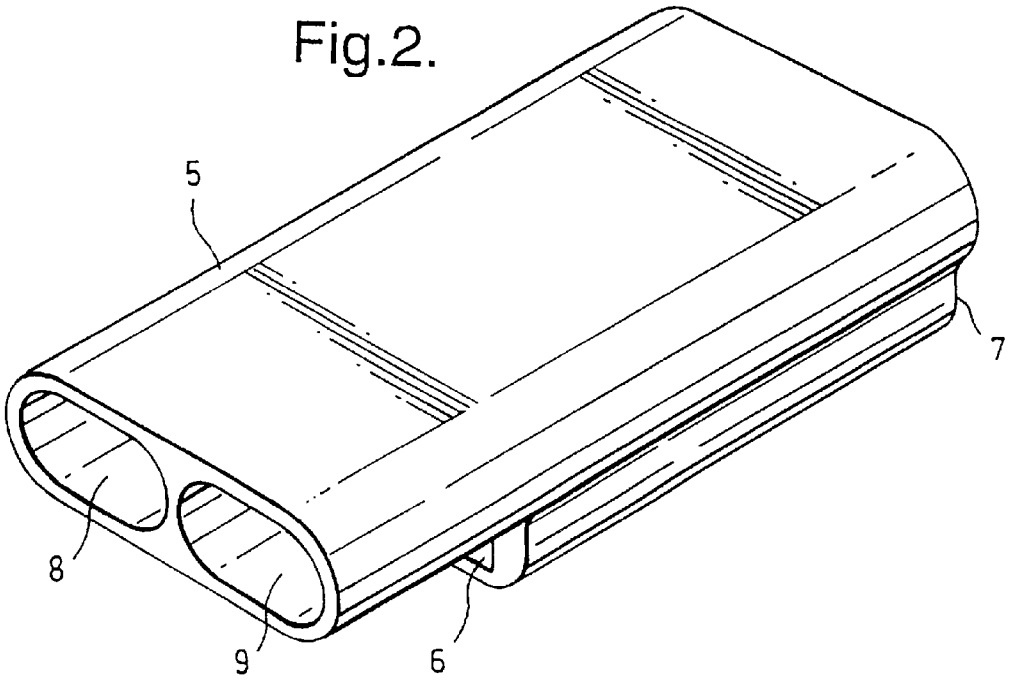

PLUG ASSEMBLY FOR DATA TRANSMISSION AND METHOD OF WIRING SAME

BACKGROUND OF THE INVENTION

1. Field of the Invention

This invention relates to a plug assembly for data transmission, and to a method of wiring the same. The preferred embodiment of the invention provides a plug suitable for category 6 data transmission installations which provides reduced near end and far end cross-talk levels as compared with conventional data transmission plugs.

2. The Prior Art

The use of mating plugs and jacks in data transmission installations is well known. As data transmission rates have increased more care has been applied to the design of all plugs and jacks in order to reduce to a minimum cross-talk induced by the plugs and jacks. Various schemes have been proposed for substantially reducing the cross-talk induced by a jack including, in particular, the use of cross-talk cancelling components on the circuit board to which the jack is conventionally secured.

Dealing with the problem of the cross-talk generated within the plug has proved more difficult. In this context, it must be remembered that the plugs in question are inherently of small size and they are required to have an array of parallel contacts for mating with corresponding contacts in the jack. The array of parallel contacts itself induces cross-talk within the plug. Further, the need to untwist the usually twisted pairs of conductors in order to connect the individual conductors to the contacts induces further cross-talk. Because of the small size of the plug, the techniques used for the purposes of reducing cross-talk in jacks cannot be applied directly to the plug. To an extent, the cross-talk induced by a plug may be cancelled by appropriate selection of cancellation components on the circuit board of the jack into which the plug is inserted. Unfortunately, however, the cross-talk induced by a plug tends to be very variable, at least in part as a result of the variations in positions of the conductors within the plug. Accordingly, including cross-talk cancelling components on the jack circuit board cannot be used reliably as a method of compensating for cross-talk induced in a plug inserted into the jack.

Typically, a plug may have eight contacts which are separately connected to the conductors of four twisted pairs of conductors. For the purposes of this discussion the conductors of the first twisted pair are designated A and B; the conductors of the second twisted pair are designated C and D; the conductors of the third twisted pair are designated E and F; and the conductors of the fourth twisted pair are designated G and H. By convention one conductor of each pair is coloured to identify the pair and the other conductor of each pair is predominantly white but has bands of colour corresponding to its associated coloured conductor. For the purposes of this discussion conductors A,C,E and G will be considered to be coloured conductors and conductors B,D,F and H will be predominantly white conductors. In standard four twisted pair cables the coloured conductors are coloured brown, green, blue and orange and for the purposes of this description conductor A will be regarded as,the brown conductor, conductor C will be regarded as the green conductor, conductor E will be regarded as the blue conductor and conductor G will be regarded as the orange conductor. It follows from the above that conductor B will be predominantly white but with brown bands, conductor D will be predominantly white but with green bands, conductor F will be predominantly white but with blue bands and conductor H will be predominantly white but with orange bands.

In the standard and enhanced version of the common RJ45 plug the conductors are connected toga linear array of eight parallel side-by-side contacts. The common 258A and 568B wiring conventions require the conductors to be connected to the contacts so that the conductor order, measured from end to end of the linear array, is ABCFEDGH. This arrangement is recognised as reducing the cross-talk particularly between the CD pair and the EF pair.

RJ45 type plugs still, however, produce a significant amount of cross-talk which in turn makes it very difficult to produce plugs which satisfy category 6 cross-talk standards. Cross-talk is largely induced by the parallel array of contacts within the plug and by the fact that the conductors must run parallel to each other in the zone immediately adjacent the connection to the contacts. The problem of cross-talk is further complicated by the fact that the individual conductors are, at the present time, to an extend randomly located within the plug body. As a result, although some plugs may attain an acceptable cross-talk level, others which are nominally identical do not. As noted above, the variation between plugs of nominally identical design also renders it impracticable to compensate for plug cross-talk by means of additional components associated with a jack socket of the circuit board on which the jack socket is mounted.

We have now found that the cross-talk induced in a plug can be reduced if, in a region between the contacts and the point where the cable enters the plug, the conductors of the CD pair and the conductors of the EF pair are constrained to run with the C and E conductors adjacent each other.

In one embodiment the D and F, conductors are also constrained to run adjacent each other. In other words, in a region adjacent the contacts the conductors of the CD and EF pairs are constrained to run with the conductors which are connected to pins 3 and 5 close to each other and the conductors which are connected to pins 4 and 6 close to each other.

We have devised a number of plug arrangements which utilise this routing of conductors C,D,E and F to reduce cross-talk. The different plug arrangements provide different degrees of cross-talk reduction. Whilst in many applications a plug which produces the maximum reduction in cross-talk will be required, other applications which are less demanding may utilise less efficient embodiments of the invention.

In addition to reducing cross-talk, the preferred embodiments of the present invention provide accurate control for the position of the conductors within the plug. As a result, plugs according to the preferred embodiment of the invention provide more consistent levels of cross-talk than similar plugs of the prior art. As a result, to the extent that cross-talk is produced by the plugs in the preferred embodiment this can, to an extent, be compensated for by a design of the jack or jack mounting board with which the plug is, in use, to be associated.

The desired arrangement can conveniently be achieved by use of a wiring manifold as part of the plug assembly.

In one embodiment of the invention the wiring manifold defines two channels, one for receiving the D and F conductors and the others for receiving the C and E conductors. In this embodiment the AB pair and the GH pair bypass the wiring manifold and remain as respective twisted pairs as they pass the zone of the wiring manifold. Preferably, the wiring manifold and an associated load bar include interengaging latching means whereby the wiring manifold is, in use, secured to the load bar. Preferably, the wiring manifold is of a polycarbonate material, although in some embodiments of the invention a relatively soft and flexible material, for example silicone rubber, may be used.

In another embodiment of the present invention we have found that cross-talk induced in a plug can be reduced if, in the region between the contacts and the point where the cable enters the plug, the conductors of the CD pair and the conductors of the EF pair are constrained to run with the C and E conductors adjacent each other and with the F conductor adjacent the E conductor and the D conductor adjacent the C conductor. In a particularly preferred arrangement the C and E conductors are located one above another; and the F conductor is at substantially the same level as the E conductor. In one embodiment the F conductor is located to one side of the vertical plane passing through the C and E conductors, and the D conductor is at the same level as the C conductor and on the opposite side of the said plane from the F conductor. In another embodiment the C and E conductors are located in one vertical plane and the D and F conductors are located in a second vertical plane parallel to the first vertical plane. In this arrangement the D conductor is at the same vertical level as the C conductor and the F conductor is at the same vertical level as the E conductor. Preferably, the spacing between the C and D conductors is the same as the spacing between the C and the E conductors which is in turn the same as the spacing between the E and the F conductors which is in turn the same as the spacing between the F and the D conductors. In the preferred embodiment of the invention when the plug is viewed in transverse cross section, the C,D,E and F conductors are located at the respective corners of a square with the C conductor diametrically opposite the F conductor and the D conductor diametrically opposite the E conductor.

In one embodiment of the invention a wiring manifold is provided which includes three channels. The centre channel holds the C and E conductors adjacent each other with the C conductor above the E conductor. A second of the channels is located offset to one side of the first channel and holds the F and G conductors with the F conductor located, adjacent the E conductor. The third channel is located offset to the opposite side of the first channel and holds the D and B conductors with the D conductor adjacent the C conductor. The second and third channels are vertically offset from each other so that the F and G conductors are at the same level as the E conductor and the D and B conductors are at the same level as the C conductor.

Preferably, tie wiring manifold includes channels in the outer surface thereof to guide the A and H conductors. The guide for the H conductor is preferably located vertically above the G conductor and the guide for the A conductor is located vertically below the B conductor. This arrangement has been found to give particularly advantageous cancelling results when used in an enhanced RJ45 plug. Preferably, the body of the plug includes a portion or a separate load bar member which defines eight side-by-side parallel passages each for a respective one of the conductors. With such an arrangement, after the respective conductors exit their channels in the wiring manifold they can be directed as necessary through the passages in the load bar to be presented to the contacts in the correct order.

In another embodiment of the invention a wiring manifold is provided which defines six channels. Five of the channels are designed to carry one conductor whilst the sixth channel is designed to carry three conductors in a side by side arrangement. With such a wiring manifold the C and E conductors are constrained to run parallel to each other through the wiring manifold one above the other. The G and the H conductors pass through the same channel as the E conductor with the H conductor located between the G conductor and the E conductor. The E and F conductors pass through respective side by side channels with the E conductor adjacent the C conductor and the D conductor adjacent the F conductor. The A and B conductors run through respective channels located at the opposite extremity of the wiring manifold from the channel for the E, G and H conductors. In cross-section, and viewed from the rear of the plug, the wiring manifold preferably constrains the B, D and C conductors to run parallel to each other in one horizontal plane with the D conductor located between the B conductor and the C conductor, and the remaining conductors to run parallel to each other in a second horizontal plane spaced from the first horizontal plane with the A conductor at one extremity, the G conductor at the opposite extremity, the F conductor next to the A conductor, the H conductor next to the G conductor, and the E conductor between the F conductor and the H conductor.

In a preferred plug and cable assembly according to the present invention the cable includes a cruciform separator for separating the respective twisted pairs of conductors. The separator terminates within the sheath of the cable a short distance from the sheath end and the wiring manifold is partially inserted within the cable sheath so that the rear of the wiring manifold abuts or is close to the end of the separator. As a result, the transition from the twisted pair and separator arrangement which exists over the majority of the length of the cable to the wiring manifold is well controlled with minimal opportunity for variation in cable position. Preferably, the cable sheath is clamped to the wiring manifold.

The invention will be better understood from the following description of a preferred embodiment thereof, given by way of example, reference being had to the accompanying drawings.

FIG. 1 shows, in perspective view, a plug load bar;

FIG. 2 shows, in perspective view, a wiring manifold;

DETAILED DESCRIPTION OF THE PREFERRED EMBODIMENTS

Figure 3:
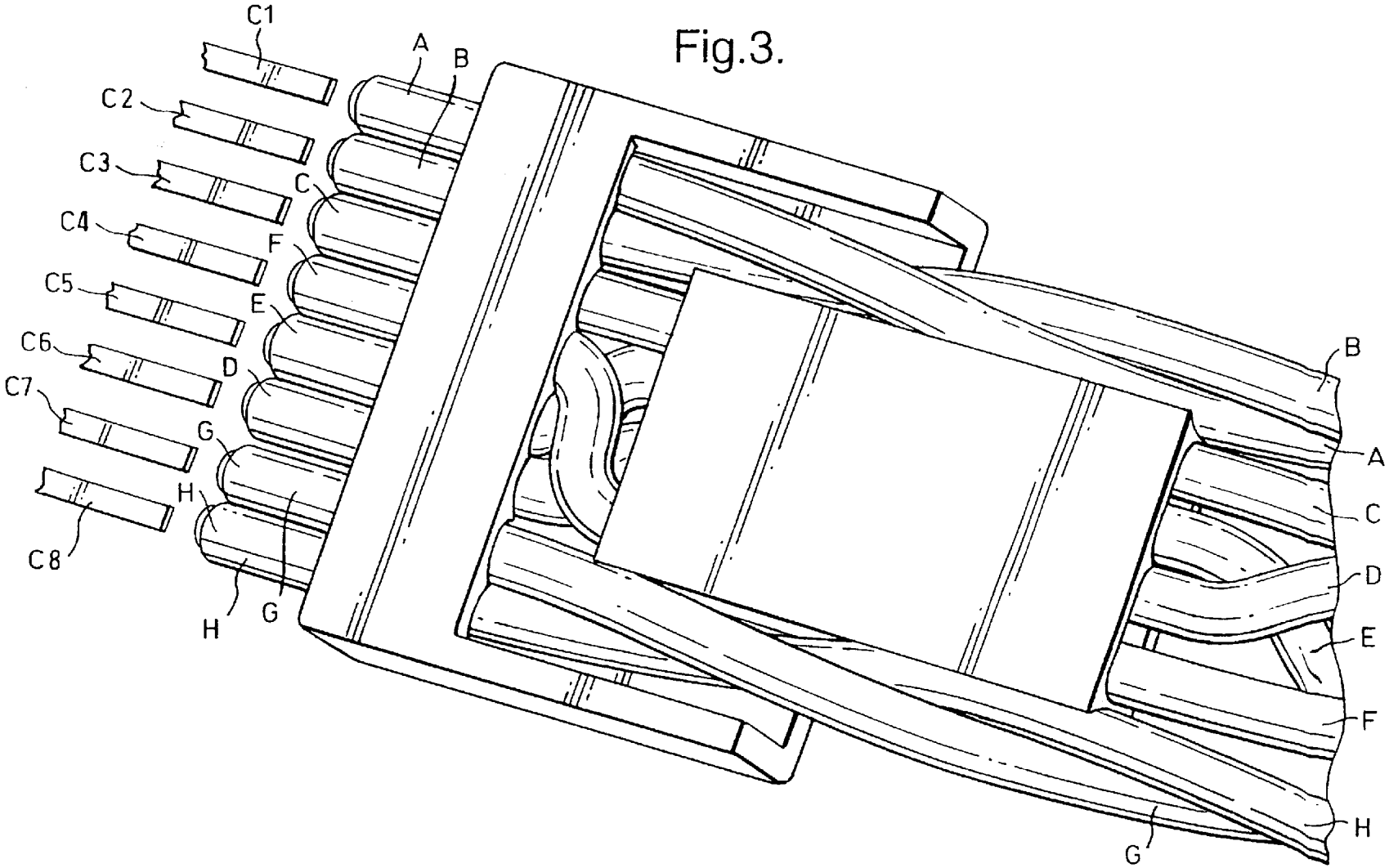
FIG. 3 shows a top plan view the wiring manifold assembled with the load bar and wired with four twisted pairs of conductors ready for assembly with a set of plug contacts.
Figure 4:
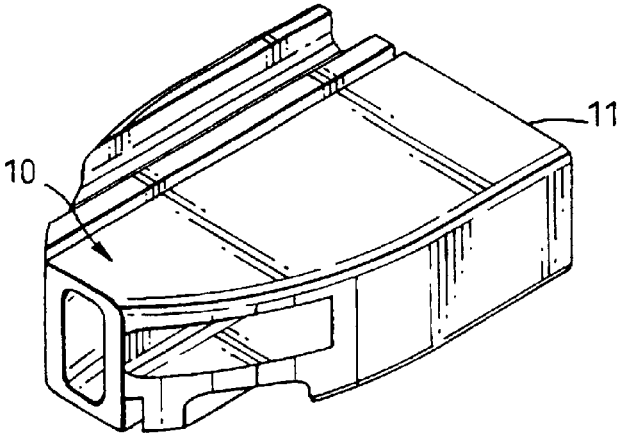
FIG. 4 is a perspective view of an alternative design of wiring manifold.
Figure 5:
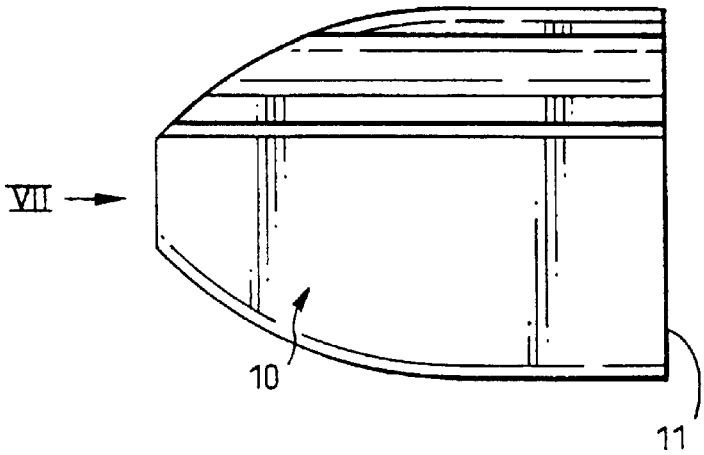
FIG. 5 is a top plan view of the wiring manifold of FIG. 4.
Figure 6:
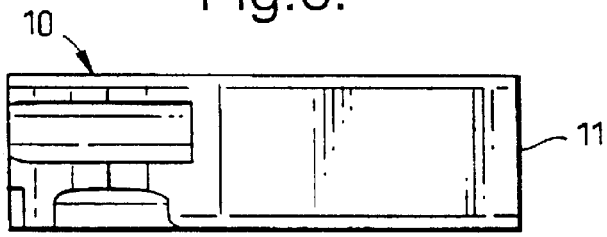
FIG. 6 is a side view of the wiring manifold of FIG. 4.

Referring firstly to FIG. 1, the load bar 1 defines eight parallel passages 2 which, in use, carry the eight conductors of a four twisted pair cable immediately adjacent the point where the conductors are connected to an array of eight contacts 3. The position of the contacts, in the final assembled form of the plug, is shown schematically in broken lines in FIG. 3 and, for the purposes of this description, the contacts are identified as C1–C8. The contacts are arranged side by side and are located generally in the same plane.

The load bar 2 defines a pair of latches 4 which, in use, are used to secure the wiring manifold 5 to the load bar. To this end, the wiring manifold 5 incorporates a channel 6 into which the latches 4 slide until the latch profiles on the free ends of the latches engage behind the end surface 7 of the wiring manifold.

The wiring manifold 5 defines two through channels 8,9. The wiring manifold can be formed with any suitable material, but is conveniently formed from a flexible and resilient material, for example silicone rubber, or a more rigid material, for example a polycarbonate.

For the purposes of identification, the individual conductors of each twisted pair have been identified by the letters A through H. The conductors of the twisted pair at one lateral extreme of the plug are identified by the letters A and B. These could, for example, be the brown and white-brown conductors of a typical four twisted pair cable. The conductors of the twisted pair at the opposite extreme of the plug are identified by the letters G and H and could, for example, be the orange, and white-orange conductors of a typical four twisted pair cable. One of the remaining twisted pairs has its conductors identified by the letters C and, D whilst the remaining twisted pair has its conductors identified by the letters E and F. In a typical installation conductor C would be green; conductor D would be white-green; conductor E would be blue and conductor F would be white-blue.

It will be noted that at the point of connection to the contacts 3 the order of the conductors (from contact C1 to contact C8) is ABCFEDGH. The twisted pair AB and the twisted pair GH remain twisted until the closest possible point to the passages 2. The twisted pairs CD and EF have been untwisted until immediately adjacent the end surface 7 of the wiring manifold. Conductors D and F have then been fed through passage 8 of the wiring manifold and conductors C and E have been fed through passage 9. At the end of the wiring manifold nearest the passages 2 the conductors D, E and F have been crossed so that the desired final configuration ABCFEDGH exists at the point where the conductors enter the passages 2.

It has been found that cross-talk can be further reduced if the wall. thickness of the wiring manifold is such as to maintain a substantial separation between the various pairs of conductors in the zone where conductors pass through the wiring manifold. In other words, the wiring manifold should maintain a substantial separation between conductor pair AB and conductor pair CE; between conductor pair CE and conductor pair DF; and between conductor pair DF and conductor pair GH. To this end, the wall thickness of the wiring manifold in the zones lying between the conductor pairs can be somewhat thicker than the wall thicknesses elsewhere around the passages 8 and 9.

It has been found that the effect of the above described arrangement is to significantly reduce the cross-talk induced between pair CD on one hand and pair EF on the other hand as compared with a comparable arrangement in which the pairs CD and EF remain twisted until immediately adjacent the passages 2.

Referring now to FIGS. 4 through 7 an alternative wiring manifold 10 is shown. This wiring manifold 10 is generally bullet-shaped when viewed in plan (FIG. 5) and is installed with the wide end 11 nearer the contacts of the plug. In practice, the wiring manifold 10 will be used in association with a load bar which defines passages for the individual conductors, somewhat similar to the passages 2 of the load bar illustrated in FIG. 1. It is believed, however, that in the case of the embodiment of FIGS. 4–7, it will not be necessary to latch the wiring manifold to the load bar in the manner that the wiring manifold of FIG. 2 is latched to the load bar of FIG. 1.

It will be noted that the wiring manifold shown in FIGS. 4–7 include three through-channels 12,13 and 14. In addition, the body defines two grooves 15 and 16. In use, the twisted pairs are unwound and the respective conductors are threaded through the passages and grooves so that the C and E conductors (that is the green and blue conductors using the conventional four twisted pair colour convention) pass through the central passage 12 with the C conductor located above the E conductor. The F and G conductors (white-blue and orange) are threaded through the passage 13 with the F conductor nearest the E conductor. The D conductor and the B conductor (white-green and white-brown) are fed through the passage 14 with the D conductor adjacent the C conductor. The A conductor (brown) is fed through the groove 16 and the H conductor (white-orange) is fed through the groove 15. At the exit end 11 of the wiring manifold 10 the conductors are bent and twisted as necessary to bring them into the desired ABCFEDGH configuration for connection to the contacts C1–C8.

Figure 7:
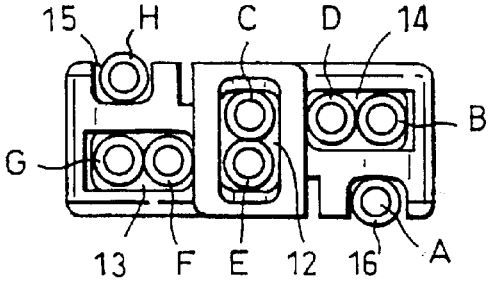
FIG. 7 is a view in the direction of the arrow VII of FIG. 5 showing the in-use position of the various conductors as they pass through the wiring manifold.

It has been found that the particular arrangement of the conductors illustrated in FIG. 7 produce a particularly good cross-talk reduction and results in substantial or a substantially complete elimination of the cross-talk produced by the parallel contacts C1–C8 and the parallel portions of the conductors as they approach the connection with the contacts. Further, because the described system controls the position of the conductors both during assembly and during final crimping of the load bar consistent results can be obtained.

It will be noted in the arrangement shown in FIG. 7 that the C and E conductors (green and blue) are constrained to run close to each other within the channel 12. The F conductor (which within the cable is twisted with the E conductor) is relatively close to the E conductor but is somewhat offset to one side thereof. Similarly, the D conductor (which within the cable is twisted with the C conductor) is relatively close to the C conductor but is offset somewhat to one side thereof. The F conductor and D conductor are offset to opposite sides of the vertical plane defined by the C and E conductors.

Figure 8:
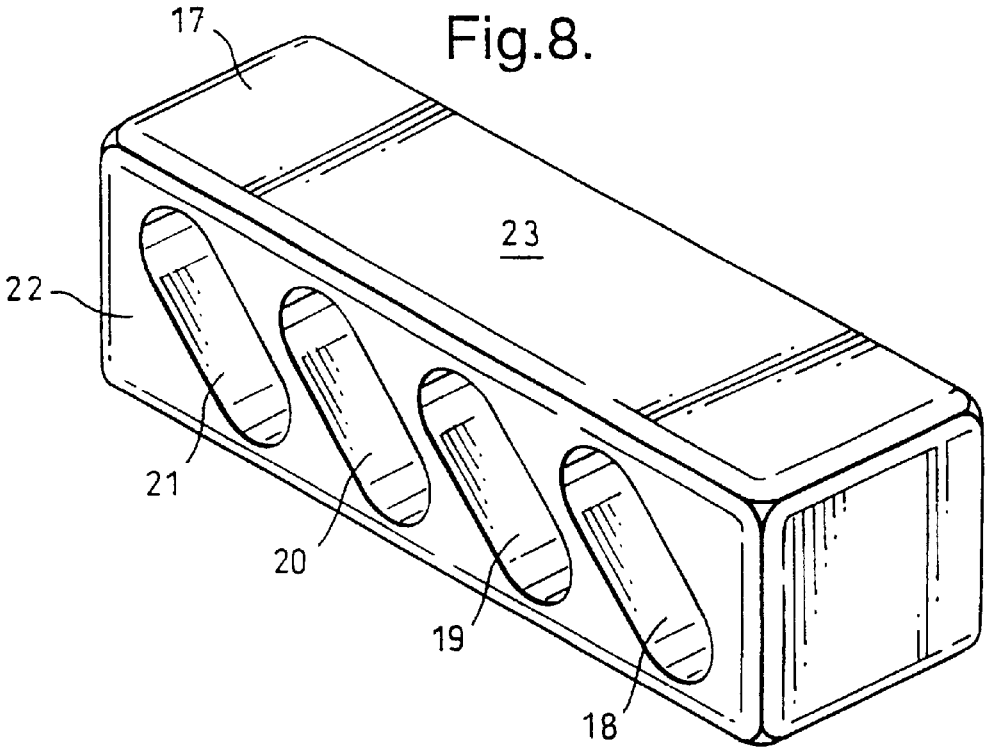
FIG. 8 is a perspective view of a further embodiment of the invention viewed from the side thereof which, in use, is nearest to the contacts of the plug.
Figure 9:
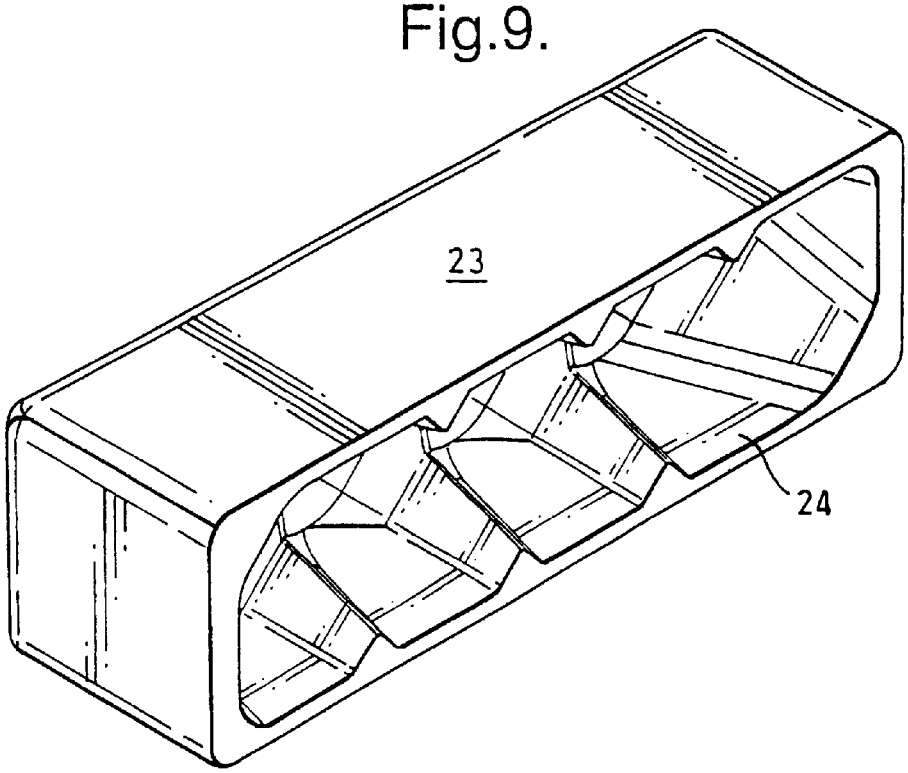
FIG. 9 is a perspective view of the wiring manifold of FIG. 8 viewed from the side thereof which, in use, is remote from the contacts.
Figure 10:
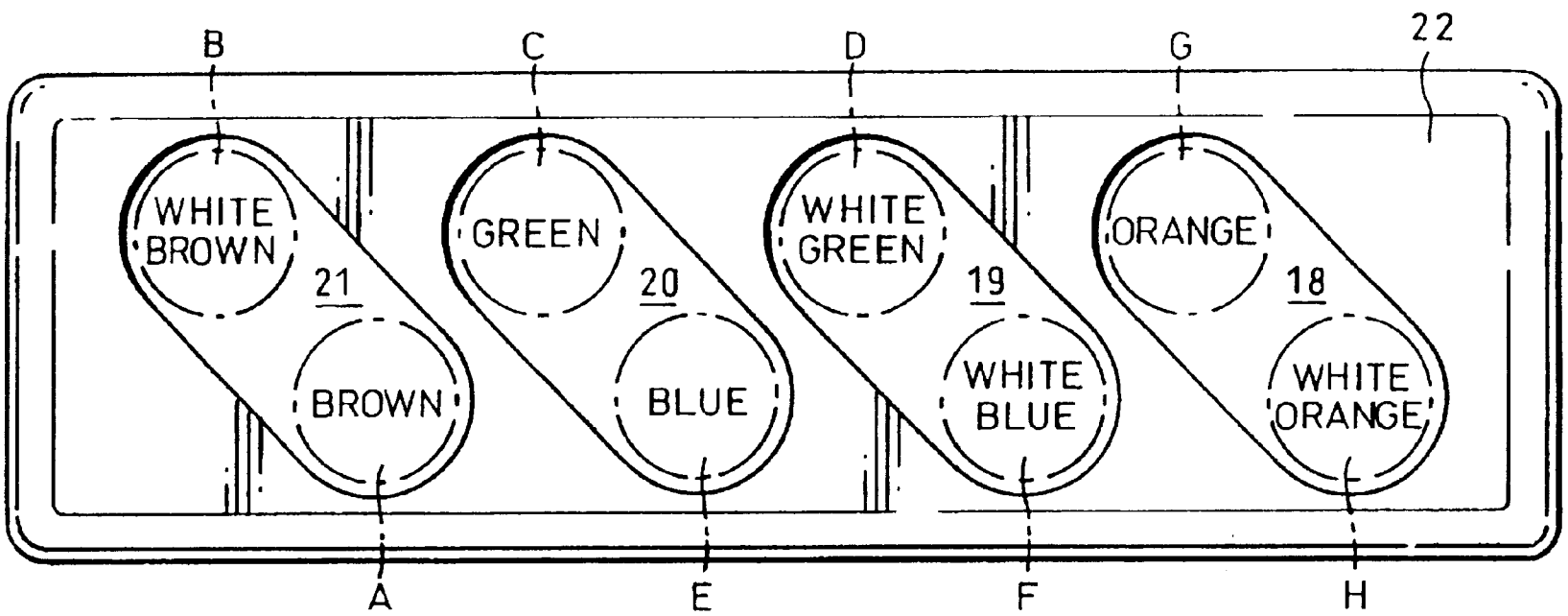
FIG. 10 is a view of the wiring manifold of FIGS. 8 and 9, viewed from the front, showing the position of the conductors in use.

Referring now to FIGS. 8–10, a further embodiment of the invention is shown. In this case, the wiring manifold 17 is in the form of a block in which is formed four through passages 18, 19, 20 and 21. At the face 22 of the wiring manifold nearer the contacts the passages each define elongate openings extending at approximately 45° to the plane of the major top surface 23 of the wiring manifold. At the rear of the wiring manifold the passages unite to form a single large passage 24. The wall of the large passage 24 is profiled to guide the individual conductors towards the through passages 18–21.

FIG. 10 shows the preferred arrangement of the conductors within the passages 18–21. It will be noted that the A and B conductors pass through the passage 21, the C and E conductors pass through the passage 20, the D and F conductors pass through passage 19 and the G and H conductors pass through the passage 18. Whilst the conductors are schematically illustrated as being spaced apart within the passages, in practice the conductors will be close to each other and probably touching over at least part of the length of the respective passages. It will also be noted in this design that the brown conductor is relatively close to the green conductor, the blue conductor is relatively close to the white-green conductor, and the white-blue conductor is relatively close to the orange conductor.

The arrangement of FIGS. 8–10 has been found to be particularly advantageous in that it is readily carried into effect in mass produced assemblies, and produces consistent results despite variations in the individual assembly technique of the operators responsible for assembling the plugs.

Referring now to FIGS. 11–19 there is illustrated a further embodiment of the invention. This embodiment has been found to provide a high level of cross-talk reduction and a high level of cross-talk consistency. This embodiment is accordingly particularly suitable in arrangements required to meet Category 6 standards. To this end, the embodiment will in general be used with Category 6 cable which is illustrated in cross-section in FIG. 19. It will be noted that this cable includes a sheath 30 which encloses four twisted pairs 31,32,33,34 of insulated conductors. The respective twisted pairs are separated from each other by a separator 35 which is cruciform in cross-section. In a standard Category 6 cable the conductors of pair 31 are respectively brown and white with brown bands and correspond to conductors A and B of the present description. The conductors of pair 32 are blue and white with blue bands and correspond to conductors E and F of the present description. The conductors of pair 33 are orange and white with orange bands and correspond to conductors G and H of the present description. The conductors of pair 34 are respectively green and white with green bands and correspond to conductors C and D of the present invention.

Figure 11:
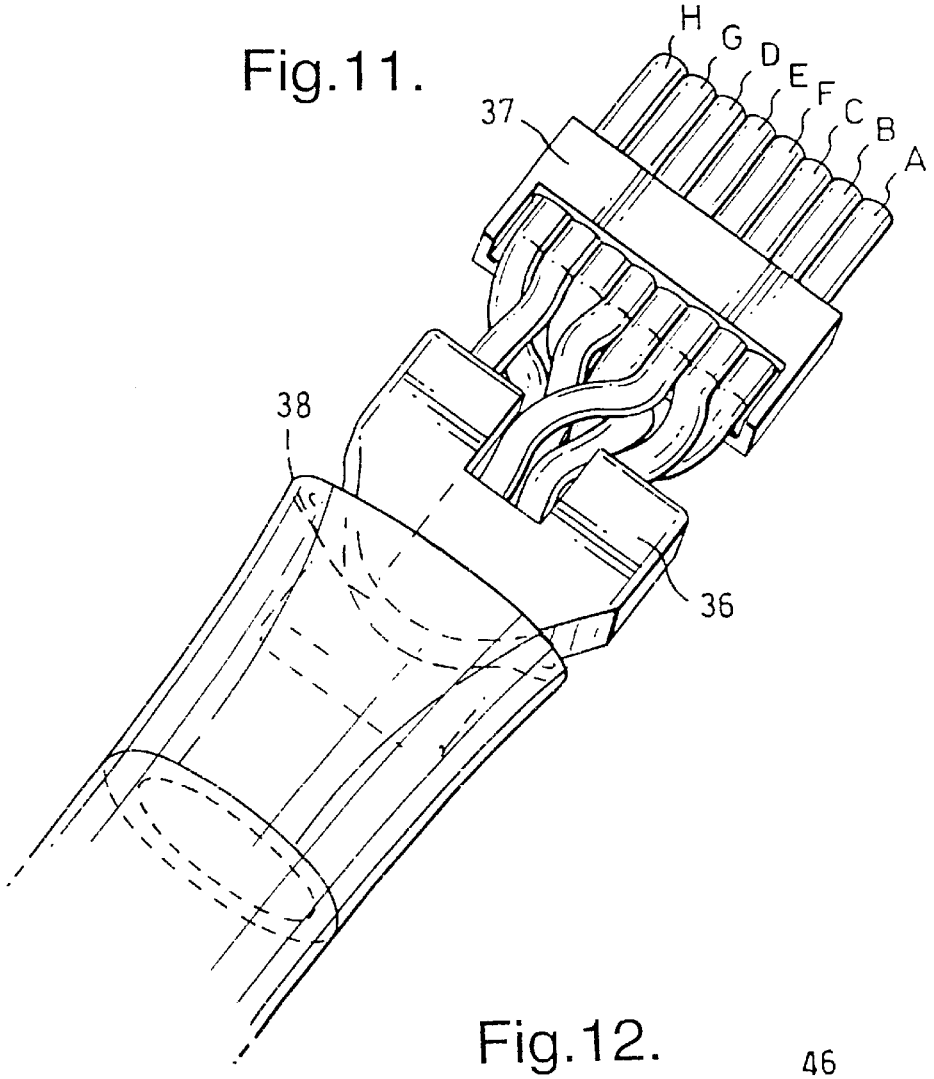
FIG. 11 is a perspective view of components of a further embodiment of the present invention.
Figure 12:
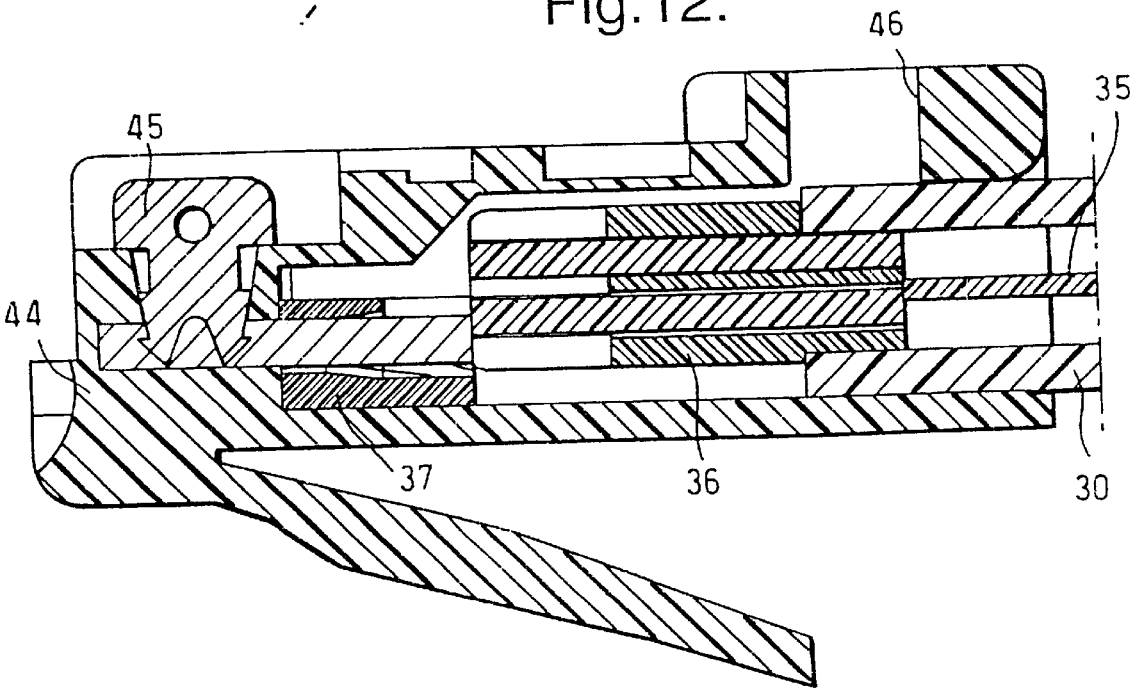
FIG. 12 is a longitudinal view of a cross-section of a plug and cable assembly utilising the components of FIG. 11.

Turning now to FIG. 11, the various conductors of the cable pass through a wiring manifold 36 and a load member 37 and are presented for connection, to contacts C1–C8 in the order ABCFEDGH.

The wiring manifold 36 is generally of bullet-shape with a relatively narrow rearward extension 38 which, in use, fits within the end of the cable sleeve 30 to abut the end of the separator 35 which, for this purpose, is cut back short of the end of the sheath 30. This arrangement is illustrated, in FIG. 12.

The wiring manifold 36 defines a total of 6 through-channels arranged in 2 parallel spaced apart horizontal planes. Five of the channels (38,39,40,41 and 42) each carry a single respective conductor BDCA and F. The remaining channel 43 carries, the three conductors EH and G with the H conductor located between the E conductor and the G conductor.

Figure 13:
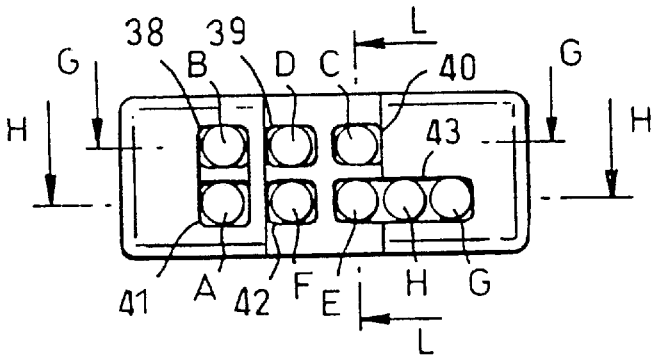
FIG. 13 is a view from the front of the plug of the wiring manifold of the embodiment of FIG. 11.
Figure 14:
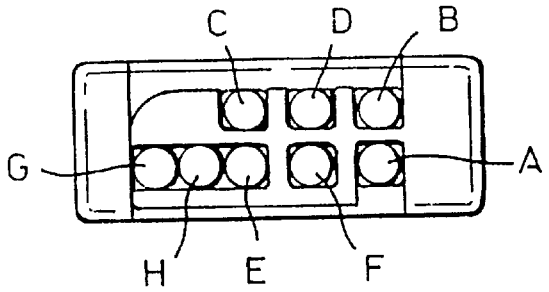
FIG. 14 is a view from the rear of the plug of the wiring manifold of the embodiment of FIG. 11.
Figure 15:
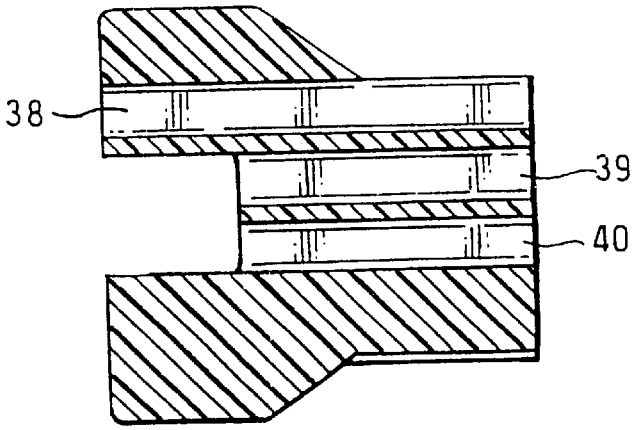
FIG. 15 is a section on the line GG of FIG. 13.
Figure 16:
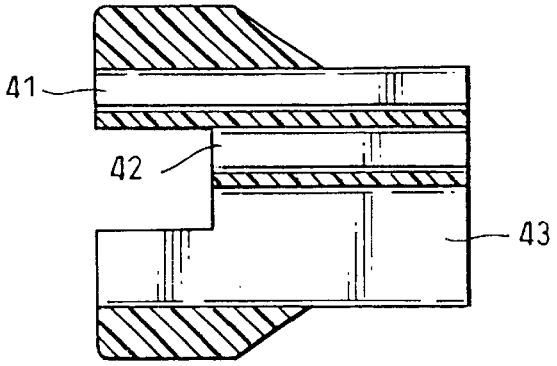
FIG. 16 is a cross-section on the line HH of FIG. 13.
Figure 17:
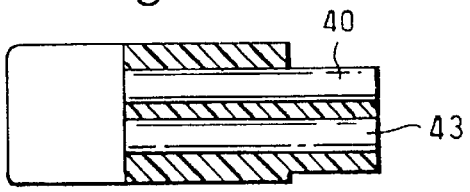
FIG. 17 is a cross-section on the line LL of FIG. 13.
Figure 18:
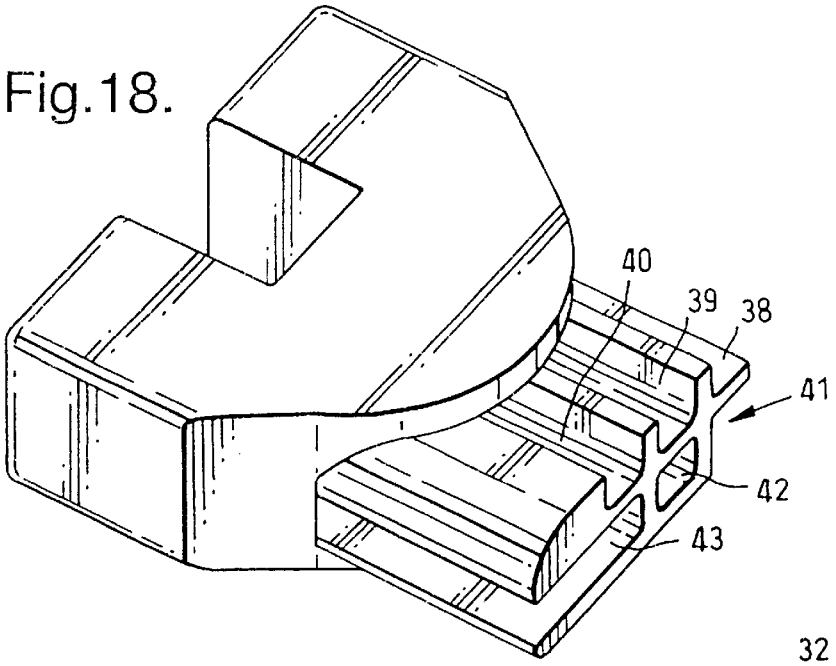
FIG. 18 is a perspective view of the wiring manifold of FIGS. 13–17.
Figure 19:
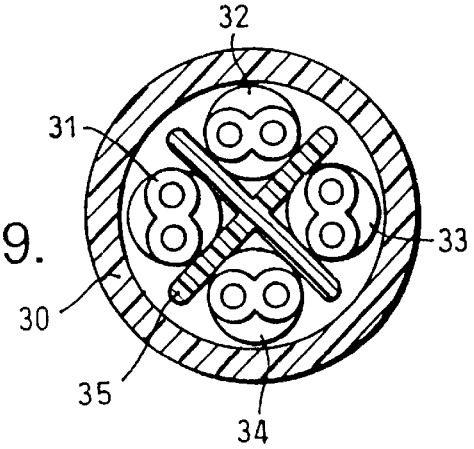
FIG. 19 is a cross-section of the cable connected to the plug of FIG. 12.

For the purposes of illustration, the conductors A–H are illustrated in their respective channels in FIGS. 13 and 14, but have been omitted from the cross-sectional views of FIGS. 15,16 and 17.

It will be noted that the C conductor is adjacent the E conductor and the D conductor is adjacent the F conductor with the C,D,E, F conductors arranged at the corners of a square.

As the conductors leave the wiring manifold the C conductor crosses over the F conductor, the D conductor crosses under both the F conductor and the E conductor, and the H conductor crosses under the G conductor before all the conductors pass through respective channels provided in the load bar 37. This arrangement has been found to be readily achievable using mass-production techniques and results in a conductor array ABCFEDGH for insertion into the plug body 44. After insertion, contacts 45 (only one of which is visible in FIG. 12) are inserted in a conventional manner to provide electrical contact with the conductors A–H. Finally, a suitable clamping member is inserted through opening. 46 in the plug body to clamp the cable sheath 30 against the wiring manifold 36 and to provide mechanical locking of the sheath 30 to the plug body.

It will be appreciated that because conductors C and D form one twisted pair and conductors E and F form another twisted pair, and the respective conductors of each twisted pair carry essentially positive going and negative going versions of the same signal, the arrangements described above are substantially unaffected if the conductors C and D are reversed and the conductors E and F are reversed. Another words, whilst the present invention provides improved cross-talk if the C conductor is routed near the E conductor within the plug, the same advantages will be obtained if the D conductor was routed near the F conductor. All such reversed arrangements fall within the scope of the present invention and are covered by the appended claims.

It will be appreciated that whilst a particular orientation of the plug has been used in the description, to assist a clear understanding of the relative disposition of the conductors in accordance with the invention, the actual orientation of the plug is not critical and provided that the desired relative relationships of the conductors is maintained the actual position of the wiring manifold in space is immaterial.

What is claimed is:

1. A plug assembly for data transmission, the plug assembly comprising:

a cable having four twisted pairs of insulated conductors, the conductors of one twisted pair being designated A and B respectively, the conductors of a second twisted pair being designated C and D respectively, the conductors of a third twisted pair being designated E and F respectively, and the conductors of the remaining twisted pair being designated G and H respectively; and a plug having a linear array of eight contacts to which the respective conductors are connected so that the order in which the conductors are connected to the contacts from one end of the array of contacts to the other is ABCFEDGH;

wherein the conductors are constrained to run with the C and E conductors adjacent each other and the D and F conductors adjacent each other, said conductors being constrained to run adjacent each other in a region between the contacts and the point where the cable enters the plug, and wherein, when the plug is viewed in transverse cross-section in said region, the C, D, E and F conductors are located at the corners of a square with the F conductor diametrically opposite the C conductor and the E conductor diametrically opposite the D conductor.

2. A plug assembly according to claim 1 wherein the conductors are constrained to run in a region between the contacts and the point where the cable enters the plug with the D and F conductors adjacent each other.

3. A plug assembly according to claim 1 including a load bar located between the contacts and the said region, the load bar having eight passages located in a linear array for receiving the conductors in the same order as they are connected to the contacts.

4. A plug assembly according to claim 1 wherein the conductors are constrained to run in the region between the contacts and the point where the cable enters the plug by a wiring manifold which includes passages through which at least some of the conductors pass.

5. A plug assembly according to claim 4 wherein the wiring manifold has six passages: one for the A conductor, one for the B conductor, one for the C conductor, one for the D conductor, one for the F conductor, and one for the E, H and G conductors.

6. A plug assembly according to claim 5 wherein the E, H and G conductors are arranged side by side in the through passage with the H conductor located between the E conductor and the G conductor.

7. A plug assembly according to claim 5 wherein the passages are arranged in two layers with the passages for the B, D and C conductors located in one layer and the remaining passages located in another layer, the B conductor being directly above the A conductor, the D conductor being directly above the F conductor and the C conductor being located directly above the E conductor.

8. A plug assembly according to claim 1 wherein the cable includes a sheath and the wiring manifold extends in to the cable sheath.

9. A plug assembly according to claim 8 wherein the cable sheath is clamped to the wiring manifold.

10. A plug assembly according to claim 8 wherein the cable includes a cruciform separator which separates the respective twisted pairs and wherein the wiring manifold abuts the end of the cruciform separator.

* * * * *